US006566801B1

(12) United States Patent
Van Der Vaart et al.

(10) Patent No.: US 6,566,801 B1
(45) Date of Patent: May 20, 2003

(54) CATHODE RAY TUBE

(75) Inventors: Nijs C. Van Der Vaart, Eindhoven (NL); Petrus H. F. Trompenaars, Eindhoven (NL); Eduard M. J. Niessen, Eindhoven (NL); Gerardus G. P. Van Gorkom, Eindhoven (NL)

(73) Assignee: Koninklijke Philips Electronics N. V., Eindhoven (NL)

( * ) Notice: Subject to any disclaimer, the term of this patent is extended or adjusted under 35 U.S.C. 154(b) by 323 days.

(21) Appl. No.: 09/598,540

(22) Filed: Jun. 21, 2000

(30) Foreign Application Priority Data

Jun. 22, 1999 (EP) ..... 99201996

(51) Int. Cl.[7] ..... H01J 29/48

(52) U.S. Cl. ..... 313/446; 313/409; 313/458; 313/103 R; 315/15; 315/368.15; 315/382; 315/382.1

(58) Field of Search ..... 313/409, 446, 313/417, 103 R, 103 CM, 105 R, 105 CM; 315/15, 368.15, 382, 382.1

(56) References Cited

U.S. PATENT DOCUMENTS 5,270,611 A 12/1993 Van Gorkom ..... 313/422
5,729,244 A 3/1998 Lockwood ..... 345/74
5,955,833 A * 9/1999 Janning ..... 313/103 R

* cited by examiner

*Primary Examiner*—Ashok Patel

(57) ABSTRACT

A cathode ray tube comprising an electron source and an electron beam guidance cavity having an input aperture and an output aperture, wherein at least a part of the wall of the electron beam guidance cavity near the output aperture comprises an insulating material having a secondary emission coefficient δ1 for cooperation with the cathode. Furthermore, the cathode ray tube comprises a first electrode connectable to a first voltage source for applying, in operation, an electric field with a first field strength E1 between the cathode and the output aperture. δ1 and E1 have values which enable electron transport through the electron beam guidance cavity. A second electrode is placed between the cathode and the cavity. The second electrode is connected to a second voltage source for applying, in operation, an electric field with a second field strength E2 between the cathode and the second electrode for controlling the emission of electrons.

51 Claims, 3 Drawing Sheets

CATHODE RAY TUBE

BACKGROUND OF THE INVENTION

1. Field of the Invention

The invention relates to a cathode ray tube comprising an electron source having a cathode for emission electrons, an electron beam guidance cavity having an input aperture and an output aperture, said cavity having walls, at least a part of the wall of the electron beam guidance cavity near the output aperture comprising an insulating isolating material having a secondary emission coefficient δ1 for cooperation with the cathode, and a first electrode connectable to a first voltage source for applying, in operation, an electric field with a first field strength E1 between the cathode and the output aperture, δ1 and E1 having values which enable electron transport through the electron beam guidance cavity.

2. Description of the Related Art

Such a cathode ray tube is known from U.S. Pat. No. 5,270,611 which describes a cathode ray tube is described which is provided with the cathode, the electron beam guidance cavity and the first electrode connectable to a first voltage source for applying the electric field with a first field strength E1 between the cathode and the output aperture. Furthermore, the secondary emission coefficient δ1 and E1 have values which enable electron transport through the electron beam guidance cavity. The electron transport within the cavity is possible when a sufficiently strong electric field is applied in a longitudinal direction of the electron beam guidance cavity. The value of this field depends on the type of material and on the geometry and sizes of the walls of the cavity. The electron transport then takes place via a secondary emission process so that, for each electron impinging on a cavity wall, one electron is emitted on average. The circumstances can be chosen to be such that as many electrons enter the input aperture of the electron beam guidance cavity as will leave the output aperture. When the output aperture is much smaller than the input aperture, an electron compressor is formed which concentrates the luminosity of the electron source by a factor of, for example, 100 to 1000. Such a cathode ray tube may be used in television display devices, computer monitors and projection TVs.

The electron beam current of the known device can be modulated by a variation of the voltage supplied to the first electrode.

A drawback of the known device is that the modulation voltage on the first electrode must be relatively high. For example, a modulation voltage of 200 volts is necessary for modulating of a current between 0.1 and 2 mA. Therefore, relatively expensive high-voltage electronics is required for the driving circuits of the cathode ray tube.

SUMMARY OF THE INVENTION

It is, inter alia, an object of the invention to provide a cathode ray tube in which the electron beam current is modulated with a relatively low voltage. To this end, the cathode ray tube according to the invention is characterized in that the cathode ray tube comprises a second electrode placed between the cathode and the cavity, the second electrode being connectable to a second voltage source for applying, in operation, an electric field with a second field strength E2 between the cathode and the second electrode for controlling the emission of electrons. The invention is based on the recognition that, by placing the second electrode between the cathode and the input aperture of the electron beam guidance cavity, the pulling field near the cathode is determined by the applied voltage on the second electrode, and hence the electron beam current can be modulated. In this way, the second electrode enables modulation of the current leaving the electron beam guidance cavity with a relatively low positive voltage difference, for example, in a range from 1 to 10 volts, with respect to the cathode, when the distance between the second electrode and the cathode is small enough. Low-cost, low-voltage electronics can thus be applied in the driving circuits of the cathode ray tube. A further advantage is that the influence of modulation on the characteristics of the electron beam leaving the electron guidance cavity is reduced by applying the modulation voltage on the second electrode. The characteristics of the electron beam are, for example, spot size and velocity distribution of the electrons.

A particular version of the cathode ray tube according to the invention is characterized in that the second electrode comprises a gauze. An effective pulling field can thus be established, which directs the electrons to the input aperture of the electron beam guidance cavity.

A further embodiment of a cathode ray tube according to the invention is characterized in that the second electrode comprises an electrically conductive cavity having an inlet and an outlet, the inlet facing the cathode and the outlet facing the input aperture of the electron beam guidance cavity, the inlet being covered with the gauze for creating, in operation, an electric field-free space in the conductive cavity.

A further embodiment of a cathode ray tube according to the invention is characterized in that the electrically conductive cavity comprises a hollow, conductive cylinder. In this way, the field-free space is extended within the cylinder, and the influence of the transport electric field in the electron beam guidance cavity on the emission of electrons from the cathode is further reduced.

A further embodiment of a cathode ray tube according to the invention is characterized in that a distance between the cathode and the second electrode is in a range between 20–400 micrometer. For example, when the distance between the cathode and the second electrode is 100 micrometer, an amplitude modulation of 5 Volts is sufficient for modulating a current between 0 and 3 mA when conventional oxide cathodes are used.

A further embodiment of a cathode ray tube according to the invention is characterized in that the cathode is positioned eccentrically with respect to the output aperture of the electron beam guidance cavity. This position of the cathode prevents electrons coming from the cathode from travelling to the output aperture of the electron beam guidance cavity along a direct path, thus without interaction of the walls of the electron beam guidance cavity. The electrons that pass through the output aperture of the electron beam guidance cavity, without interaction with the walls thereof, may be disadvantageous to the electron beam characteristics of the electrons emitted from the electron beam guidance cavity.

A further embodiment of a cathode ray tube according to the invention is characterized in that the cathode ray tube comprises shielding means placed between the cathode and the output aperture to prevent electrons from travelling along a direct path from the cathode to the output aperture. This shielding means also prevents electrons coming from the cathode from travelling to the output aperture of the electron beam guidance cavity along the direct path between the cathode and the output aperture, without interaction of the walls of the electron beam guidance cavity.

A further embodiment of a cathode ray tube according to the invention is characterized in that the gauze comprises a shield plate having a diameter which is at least equal to that of the output aperture of the electron beam guidance cavity, a center of the shield plate being placed axially with respect to a center of the output aperture to prevent electrons from travelling along a direct path from the cathode to the output aperture.

A further embodiment of a cathode ray tube according to the invention is characterized in that the electron beam guidance cavity comprises a body having dimensions which are at least equal to that of the output aperture of said cavity, the body comprising an insulating material having a secondary emission coefficient δ2, δ2, and E1 having values which enables electron transport along the body towards the output aperture, the body being placed axially with respect to the output aperture.

The secondary emission coefficient δ2 of the insulating material used in the body may have the same value as the secondary emission coefficient δ2 of the insulating material used in the electron beam guidance cavity. In this way, the possibility that electrons will directly travel from the cathode to the output aperture without interactions is reduced, and the efficiency of the cathode structure is increased as compared with a cathode structure that uses a shield plate.

A further embodiment of a cathode ray tube according to the invention is characterized in that the cathode ray tube further comprises a filament for heating the cathode, the filament having first and second terminals, the first terminal being connectable to a positive terminal of a power supply means and the second terminal being connectable to a negative terminal of the power supply means, the second electrode being coupled to the first terminal and the cathode being coupled to the second terminal, a distance between the cathode and the second electrode and the applied voltage between the first and second terminal determining, in operation, the emission of electrons. The numbers of terminals of the cathode ray tube may thus be reduced, and only two terminals of the cathode ray tube are necessary to control the cathode, the second electrode and the filament. The voltage difference between the terminals of the filament determines the voltage difference between the cathode and the second electrode.

These and other aspects of the invention are apparent from and will be elucidated with reference to the embodiments described hereinafter.

DESCRIPTION OF THE PRESENTLY PREFERRED EMBODIMENT

Figure 1:
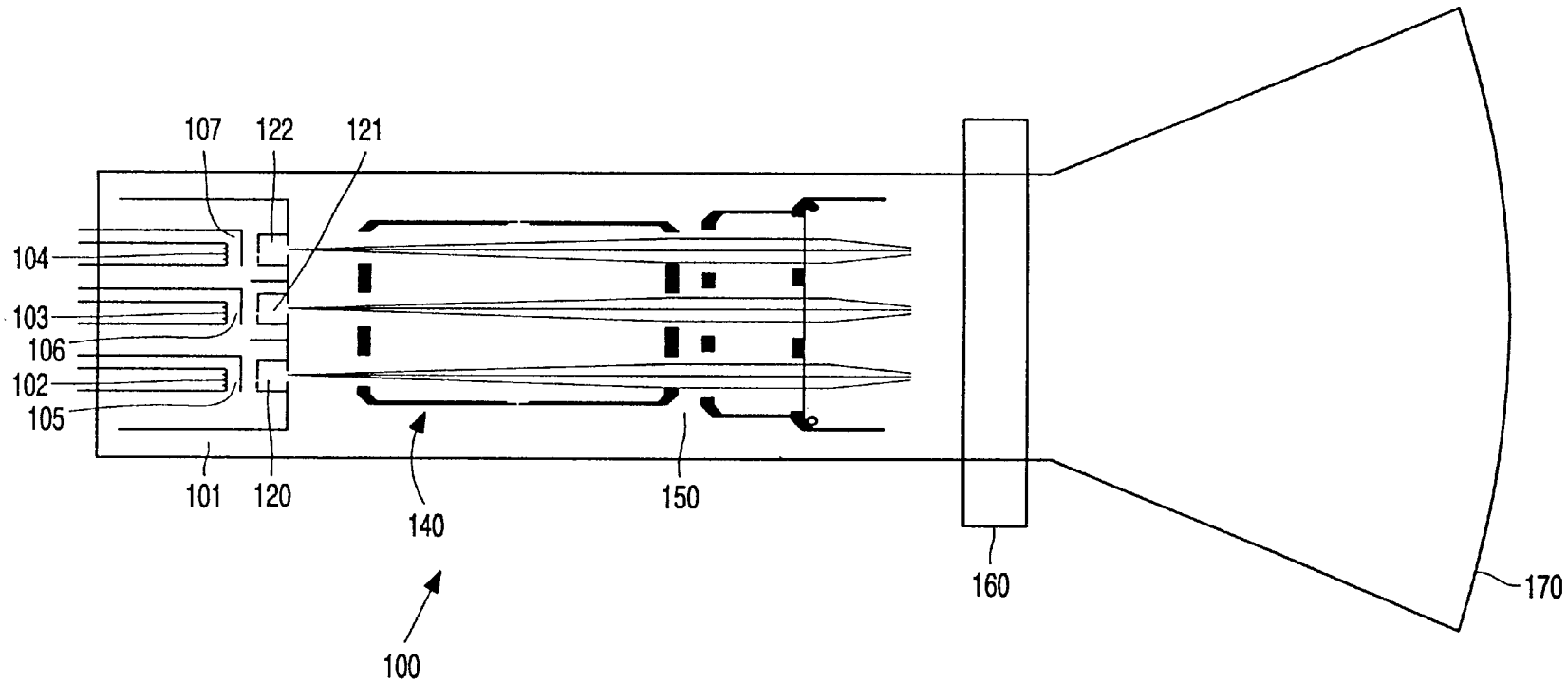
FIG. 1 is a schematic diagram of a cathode ray tube.

FIG. 1 is a schematic diagram of a known cathode ray tube. This cathode ray tube is known per se from the cited U.S. Pat. No. 5,270,611. The cathode ray tube 100 comprises an electrode structure 101 having cathodes 105,106,107 for emission of electrons, and electron beam guidance cavities 120,121,122. Preferably, the cathode ray tube comprises heating filaments 102,103,104. Furthermore, the cathode ray tube comprises an accelerating grid 140, a conventional main lens 150, a conventional magnetic deflection unit 160 and a conventional color screen 170. All these parts are known from conventional color cathode ray tubes. The cathode ray tube according to the invention may be applied in television, projection television and computer monitors.

Figure 2:
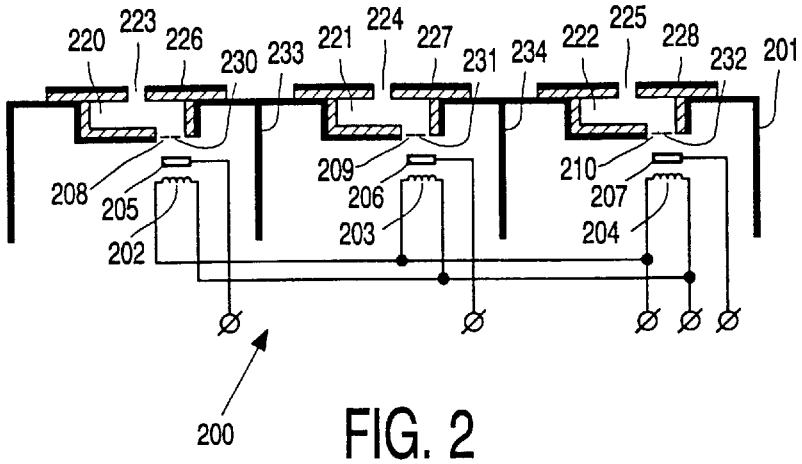
FIG. 2 shows a first embodiment of a cathode structure according to the invention for use in a cathode ray tube.

FIG. 2 shows a first embodiment of the cathode structure in accordance with the invention, which cathode structure may be applied in the cathode ray tube shown in FIG. 1 The cathode structure 200 comprises a frame 201, heating filaments 202,203,204 and cathodes 205,206,207 corresponding to each of the heating filaments. The cathodes are provided in triplicate so that the cathode ray tube may be used for the display of color images represented by red, green and blue signals. Furthermore, the cathode structure 200 comprises electron beam guidance cavities 220,221,222 each having input apertures 208,209,210, output apertures 223,224,225 and first electrodes 226,227,228. The input apertures 208,209,210 may have a square shape with dimension of 2.5×2.5 mm. At least a part of the interior around the output apertures 223,224,225 of the electron beam guidance cavities 220,221,222 is covered with an insulating material having a secondary emission coefficient δ1>1 for cooperation with the cathodes 205,206,207. This material comprises, for example, MgO. The thickness of the MgO layer is, for example, 0.5 micrometer. Other materials that can be used are, for example, glass or Kapton polyamid material. The first electrodes 226,227,228 are positioned around the output apertures 223,224,225 on the outside of the electron beam guidance cavities 220,221,222. The first electrodes consist of a metal sheet. The thickness of the metal sheet is, for example, 2.5 micrometer and can be applied by metal evaporation of, for example a combination of aluminum and chromium. The output apertures 223,224,225 may have a circular shape with a diameter of, for example, 20 micrometer.

Also a square shape with a diameter of 20 micrometer is possible.

Furthermore, each filament 202,203,204 for heating the cathodes 205,206,207 can be coupled to a first power supply means V1 (not shown). In operation, each filament 202,203,204 heats a corresponding cathode 205,206,207. The cathode comprises conventional oxide cathode material, for example, barium oxide.

In operation, the first electrodes 226,227,228 are coupled to a second power supply means VA for applying an electric field with a field strength E1 between the cathodes 205,206,207 and the output apertures 223,224,225. The voltage of the second power supply means, is for example, in the range between 100 and 1500 V, typically 700 V. The secondary emission coefficient δ and the field strength have values which enable electron transport through the electron beam guidance cavities. This kind of electron transport is known per see from the cited U.S. Pat. No. 5,270,611.

In accordance with the invention, second electrodes 230,231,232 are placed in front of the input apertures 208,209,210. The second electrodes 230,231,232 are coupled to a third power supply means VE (not shown) for applying, in operation, an electric field with a second field strength E2 between the cathodes 205,206,207 and the second electrodes 230,231,232 for controlling the emission of electrons.

Preferably, the second electrodes 230,231,232 comprise a gauze allowing a 60% transmission of electrons. The gauze can be made of a metal, for example molybdenum, and may be electrically coupled to the frame 201. In practice, all of the three gauzes 230,231,232 are electrically coupled to the frame 201. A voltage difference between the cathodes 205, 206,207 and the gauzes 230,231,232 is determined by applying a fixed voltage to the frame and varying voltages to the gauzes. In operation, a pulling field due to the voltage difference applied between the gauzes 230,231,232 and the cathodes 205,206,207 pulls the electrons away from the cathodes 205,206,207. The voltage differences between the cathodes 205,206,207 and corresponding gauzes 230,231, 232 corresponds to respective R,G,B signals which represent the image. For a further explanation of the operation of the cathode ray tube, reference is made to FIG. 1. After the electrons have left the output apertures 223,224,225 of the electron beam guidance cavities 220,221,222 the accelerating grid 140 accelerates the emitted electrons into the main lens 150. Via the main lens 150 and the deflection unit 160, the three electrode beams corresponding to the red, green and blue signals are directed to the color screen 170 in order to build the image represented by the red, green and blue signals.

Now, referring to the cathode structure of FIG. 2, when the distance between the gauzes 230,231,232 and the cathodes 205,206,207 is small enough, for example, in a range between 20 and 400 micrometer, a relatively low voltage difference between the cathodes 205,206,207 and the gauzes 230,231,232 can modulate the emission of the electrons towards the input aperture of the electron beam guidance cavities 220,221,222. For example, when a distance between the cathodes 205,206,207 and the gauzes 230,231,232 is 100 micrometer, a voltage swing of 5 volts can modulate an electron current of between 0 and 3 mA to the electron beam guidance cavities 220,221,222.

Furthermore, in the cathode structure 200, separating walls 233,234 are placed between the cathodes 205,206 and the cathodes 206,207, respectively, so as to prevent electrons from travelling from one of the cathodes to an electron beam guidance cavity other than that cavity which corresponds to said one cathode.

In order to reduce the influence of the electric transport field from the walls of the electron beam guidance cavities 220,221,222 near the cathodes 205,206,207, the second electrodes 230,231,232 can be shaped as electrically conductive cavities, for example, as a hollow metal cylinder having an inlet and an outlet.

In order to reduce the influence of electrons travelling in a direct path from the cathodes 205,206,207 to the output apertures 223,224,225 on the electron beam characteristic, the cathodes 205,206,207 are preferably placed eccentrically with respect to the output apertures 223,224,225 of the electron beam guidance cavities 220,221,222, as is shown in FIG. 2. In this patent application, a direct path is understood to be a path along which the electrons travel from the cathodes 205,206,207 to the output aperture 223,224,225 of the electron beam guidance cavities 220,221,222 without any interactions with the walls of the electron beam guidance cavities.

Other means of preventing electrons from travelling along a direct path from the cathode to the output aperture may comprise, for example, a relatively small shield plate in the gauze. This will be elucidated with reference to FIG. 4.

Figure 3:
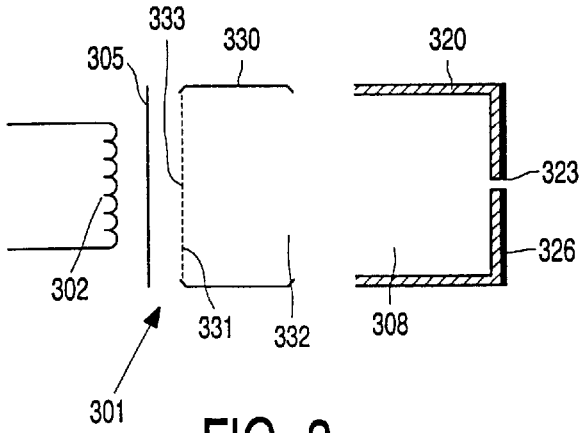
FIG. 3 shows a second embodiment of a cathode structure according to the invention.

FIG. 3 shows a second embodiment of a single cathode structure according to the invention. This cathode structure can be applied in triplicate in a cathode ray tube as shown in FIG. 1. The cathode structure 300 comprises a filament 302, a cathode 305, a first electrode 326, a cylinder 330, and an electron beam guidance cavity 320. In this embodiment, the cylinder 330 forms the second electrode. The cylinder 330 has an inlet 331 and an outlet 332. The inlet 331 faces the cathode 305 and is covered with a gauze 333. The transmission of the gauze is, for example, 60%. Instead of the gauze, a single metal plate having a hole can be applied. The dimensions of the hole are such that the transmission of the second electrode is, for example, 60%. The outlet 332 of the cylinder 330 faces the input aperture 308 of the electron beam guidance cavity 320. The electron beam guidance cavity is of the same type as that of the embodiments discussed above. By applying a voltage difference to the cylinder 330 and the cathode 305, a field-free space is created in a space just in front of the cathode 305 and the area in the electron beam guidance cavity 320 in which there is electron transport. This field-free space reduces the influence of said transport electric field pointing from the insulating walls of the electron beam guidance cavity 320 on the cathode 305 and thereby on the emission of the electrons.

Figure 4:
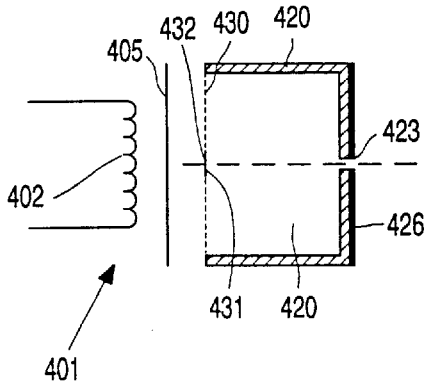
FIG. 4 shows a third embodiment of a cathode structure according to the invention.

FIG. 4 shows a third embodiment of a single cathode structure according to the invention. This cathode structure can be applied in triplicate in a cathode ray tube as shown in FIG. 1. The cathode structure comprises a filament 402, a cathode 405, a first electrode 426, a second electrode 430 and an electron beam guidance cavity 420. The second electrode 430 comprises a gauze 430 and a shield plate 431. The shield plate 431 is made of the same material as the gauze. The small shield plate 431 has at least the same dimensions as the output aperture 423 of the electron beam guidance cavity 420. A center 432 of the small shield plate 431 is axially aligned with a center 424 of the output aperture 423 of the electron beam guidance cavity 420. The electron beam guidance cavity is of the same type as that of the embodiments discussed above.

Figure 5:
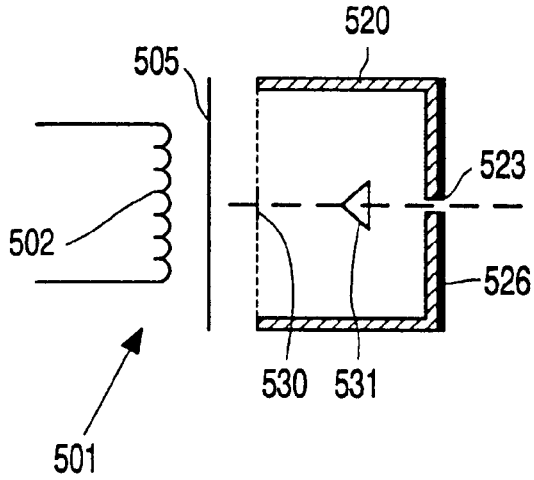
FIG. 5 shows a third embodiment of a cathode structure according to the invention.

FIG. 5 shows a fourth embodiment of a single cathode structure according to the invention. This cathode structure can be applied in triplicate in a cathode ray tube as shown in FIG. 1. The cathode structure comprises a filament 502, a cathode 505, a first electrode 526, a second electrode 530 and an electron beam guidance cavity 520. The electron beam guidance cavity 530 comprises a body of an insulating material having an emission coefficient $\delta 2>1$. The body 531 has a diameter, which is at least equal to the diameter of the output aperture 523. The body 531 is placed axially with respect to a center of the output aperture 523. For example, the body 523 can be made of a rod with a triangular cross-section. The rod comprises glass which is covered with, for example, a 0.5 micrometer thick layer of MgO. One side of the triangular rod 531 faces the output aperture 523. Apart from the presence of the triangular rod 531, the electron beam guidance cavity is of the same type as that of the embodiments discussed above.

In order to reduce the numbers of terminals of the cathode ray tube, a first of the two terminals of the filament may be coupled directly to the second electrode.

Figure 6:
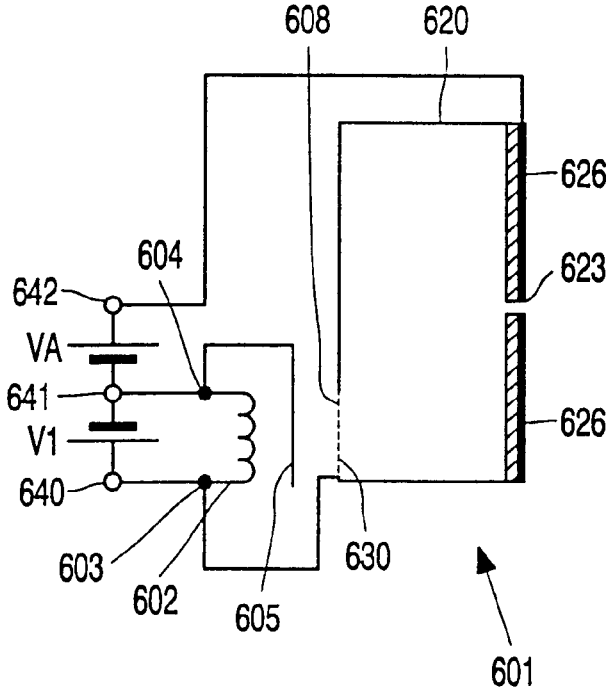
FIG. 6 shows a fourth embodiment of a cathode structure according to the invention.

FIG. 6 shows a fourth embodiment of a cathode structure 601 with a reduced number of terminals. This cathode structure can be applied in triplicate in a cathode ray tube as shown in FIG. 1. The cathode structure comprises a filament 602 having first and second terminals 603,604, a cathode 605, a first electrode 626, a second electrode 630 and an electron beam guidance cavity 620 having an input aperture 608 and an output aperture 623. The electron beam guidance cavity is of the same type as that of the embodiments discussed above. The second electrode 630 comprises a conductive gauze which covers the input aperture 608. The first electrode 626 is applied around the output aperture 623 by vacuum evaporation of a metal. The first terminal 603 of the filament is coupled to a positive terminal 640 of a first power supply V1, and the second terminal 604 of the filament 602 is coupled to a negative terminal 641 of the first power supply. V1 is, for example, 6V. The cathode 605 is coupled to the second terminal 604 of the filament 602. The first electrode 626 is coupled to a positive terminal 642 of a second power supply means VA. VA is, for example, 1000V. Now, the voltage difference between the two terminals 603,604 of the filament 602 equals that between the second electrode 630 and a surface of the cathode 605. The distance between the second electrode 630 and the cathode 605, together with the applied voltage V1 of the first power supply determines, in operation, the electron emission of the cathode 605. These electric couplings of the cathode 605 and the second electrode 630 can be made inside the cathode ray tube, so that the number of external terminals of the cathode ray tube is reduced.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A cathode ray tube, comprising:

an electron source including a cathode operable to emit electrons;

an electron beam guidance cavity having an input aperture and an output aperture;

a first electrode operable to apply a first electric field between said output aperture and said cathode; and a second electrode operable to apply a second electric field between said cathode and said second electrode, said second electric field for controlling the emission of electrons from said cathode, wherein said second electrode includes a gauze operable to transmit a portion of the emitted electrons from said cathode to said electron beam guidance cavity, the first electric field and a first secondary emission coefficient associated with said electron beam guidance cavity for enabling electron transport through said electron beam guidance cavity in response to the portion of the emitted electrons entering said input aperture.

2. The cathode ray tube of claim 1, wherein said second electrode further includes an electrically conductive cavity having an inlet and an outlet, said inlet facing said cathode and said outlet facing said input aperture of said electron beam guidance cavity.

3. The cathode ray tube of claim 2, wherein said gauze covers said inlet.

4. The cathode ray tube of claim 2, wherein said electrically conductive cavity is in the form of a hollow, conductive cylinder.

5. The cathode ray tube of claim 1, wherein said second electrode further includes an electrically conductive cavity; and wherein said electrically conductive cavity and said cathode are operable to establish an electric field-free space between said cathode and said outer aperture.

6. The cathode ray tube of claim 1, wherein said second electrode further includes a shield plate operable to prevent any electron of the portion of the emitted electrons from traveling along a direct path from said cathode to said output aperture.

7. The cathode ray tube of claim 6, wherein a center of said shield plate is axially aligned with a center of said output aperture.

8. The cathode ray tube of claim 6, wherein dimensions of said shield plate are at least equal to dimensions of said output aperture.

9. The cathode ray tube of claim 1, further comprising:

a body within said electron beam guidance cavity, the first electric field and a second secondary emission coefficient associated with said body for enabling electron transport along said body in response to the portion of the emitted electrons entering said input aperture.

10. The cathode ray tube of claim 9, wherein a center of said body is axially aligned with a center of said output aperture.

11. The cathode ray tube of claim 9, wherein dimensions of said body are at least equal to dimensions of said output aperture.

12. The cathode ray tube of claim 1, further comprising:

a filament operable to heat said cathode.

13. The cathode ray tube of claim 12, further comprising:

a first power supply including a first positive terminal and a negative terminal, wherein said filament is coupled to said first positive terminal and said negative terminal, wherein said cathode is coupled to said negative terminal, and wherein said second electrode is coupled to said first positive terminal.

14. The cathode ray tube of claim 13, further comprising:

a second power supply including a second positive terminal and the negative terminal, wherein said first electrode is coupled to said second positive terminal.

15. The cathode ray tube of claim 1, further comprising:

a first power supply including a first positive terminal and a negative terminal; and a second power supply including a second positive terminal and the negative terminal, wherein said cathode is coupled to said negative terminal, wherein said first electrode is coupled to said first positive terminal, and wherein said second electrode is coupled to said second positive terminal.

16. A cathode ray tube, comprising:

an electron source including a cathode operable to emit electrons;

an electron beam guidance cavity having an input aperture and an output aperture;

a first electrode operable to apply a first electric field between said output aperture and said cathode; and a second electrode operable to apply a second electric field between said cathode and said second electrode, said second electric field for controlling the emission of electrons from said cathode, wherein said second electrode includes an electrically conductive cavity operable to transmit at least a portion of the emitted electrons from said cathode to said electron beam guidance cavity, the first electric field and a first secondary emission coefficient associated with said electron beam guidance cavity for enabling electron transport through said electron beam guidance cavity in response to the at least a portion of the emitted electrons entering said input aperture.

17. The cathode ray tube of claim 16, wherein said electrically conductive cavity has an inlet and an outlet, said inlet facing said cathode and said outlet facing said input aperture of said electron beam guidance cavity.

18. The cathode ray tube of claim 16, wherein said electrically conductive cavity and said cathode are operable to establish an electric field-free space between said cathode and said outer aperture.

19. The cathode ray tube of claim 16, wherein said electrically conductive cavity is in the form of a hollow, conductive cylinder.

20. The cathode ray tube of claim 16, wherein said second electrode further includes a shield plate operable to prevent any electron of the portion of the emitted electrons from traveling along a direct path from said cathode to said output aperture.

21. The cathode ray tube of claim 20, wherein a center of said shield plate is axially aligned with a center of said output aperture.

22. The cathode ray tube of claim 20, wherein dimensions of said shield plate are at least equal to dimensions of said output aperture.

23. The cathode ray tube of claim 16, further comprising:

a body within said electron beam guidance cavity, the first electric field and a second secondary emission coefficient associated with said body for enabling electron transport along said body in response to the portion of the emitted electrons entering said input aperture.

24. The cathode ray tube of claim 23, wherein a center of said body is axially aligned with a center of said output aperture.

25. The cathode ray tube of claim 23, wherein dimensions of said body are at least equal to dimensions of said output aperture.

26. The cathode ray tube of claim 16, further comprising:

a filament operable to heat said cathode.

27. The cathode ray tube of claim 26, further comprising:

a first power supply including a first positive terminal and a negative terminal, wherein said filament is coupled to said first positive terminal and said negative terminal, wherein said cathode is coupled to said negative terminal, and wherein said second electrode is coupled to said first positive terminal.

28. The cathode ray tube of claim 27, further comprising:

a second power supply including a second positive terminal and the negative terminal, wherein said first electrode is coupled to said second positive terminal.

29. The cathode ray tube of claim 16, further comprising:

a first power supply including a first positive terminal and a negative terminal; and a second power supply including a second positive terminal and the negative terminal, wherein said cathode is coupled to said negative terminal, wherein said first electrode is coupled to said first positive terminal, and wherein said second electrode is coupled to said second positive terminal.

30. A cathode ray tube, comprising:

an electron source including a cathode operable to emit electrons;

an electron beam guidance cavity having an input aperture and an output aperture;

a first electrode operable to apply a first electric field between said output aperture and said cathode; and a second electrode operable to apply a second electric field between said cathode and said second electrode, said second electric field for controlling the emission of electrons from said cathode, said second electrode further operable to transmit at least a portion of the emitted electrons from said cathode to said electron beam guidance cavity, the first electric field and a first secondary emission coefficient associated with said electron beam guidance cavity for enabling electron transport through said electron beam guidance cavity in response to the at least a portion of the emitted electrons entering said input aperture, wherein said second electrode includes a shield plate operable to prevent any electron of the at least portion of the emitted electrons from traveling along a direct path from said cathode to said output aperture.

31. The cathode ray tube of claim 30, wherein a center of said shield plate is axially aligned with a center of said output aperture.

32. The cathode ray tube of claim 30, wherein dimensions of said shield plate are at least equal to dimensions of said output aperture.

33. The cathode ray tube of claim 30, further comprising:

a body within said electron beam guidance cavity, the first electric field and a second secondary emission coefficient associated with said body for enabling electron transport along said body in response to the portion of the emitted electrons entering said input aperture.

34. The cathode ray tube of claim 33, wherein a center of said body is axially aligned with a center of said output aperture.

35. The cathode ray tube of claim 33, wherein dimensions of said body are at least equal to dimensions of said output aperture.

36. The cathode ray tube of claim 30, further comprising:

a filament operable to heat said cathode.

37. The cathode ray tube of claim 36, further comprising:

a first power supply including a first positive terminal and a negative terminal, wherein said filament is coupled to said first positive terminal and said negative terminal, wherein said cathode is coupled to said negative terminal, and wherein said second electrode is coupled to said first positive terminal.

38. The cathode ray tube of claim 37, further comprising:

a second power supply including a second positive terminal and the negative terminal, wherein said first electrode is coupled to said second positive terminal.

39. The cathode ray tube of claim 30, further comprising:

a first power supply including a first positive terminal and a negative terminal; and a second power supply including a second positive terminal and the negative terminal, wherein said cathode is coupled to said negative terminal, wherein said first electrode is coupled to said first positive terminal, and wherein said second electrode is coupled to said second positive terminal.

40. A cathode ray tube, comprising:

an electron source including a cathode operable to emit electrons;

an electron beam guidance cavity having an input aperture and an output aperture;

a first electrode operable to apply a first electric field between said output aperture and said cathode;

a second electrode operable to apply a second electric field between said cathode and said second electrode, said second electric field for controlling the emission of electrons from said cathode, said second electrode further operable to transmit at least a portion of the emitted electrons from said cathode to said electron beam guidance cavity, the first electric field and a first secondary emission coefficient associated with said electron beam guidance cavity for enabling electron transport through said electron beam guidance cavity in response to the at least a portion of the emitted electrons entering said input aperture; and a body within said electron beam guidance cavity, the first electric field and a second secondary emission coefficient associated with said body for enabling electron transport along said body in response to the at least a portion of the emitted electrons entering said input aperture.

41. The cathode ray tube of claim 40, wherein a center of said body is axially aligned with a center of said output aperture.

42. The cathode ray tube of claim 40, wherein dimensions of said body are at least equal to dimensions of said output aperture.

43. The cathode ray tube of claim 40, further comprising:

a filament operable to heat said cathode.

44. The cathode ray tube of claim 43, further comprising:

a first power supply including a first positive terminal and a negative terminal, wherein said filament is coupled to said first positive terminal and said negative terminal, wherein said cathode is coupled to said negative terminal, and wherein said second electrode is coupled to said first positive terminal.

45. The cathode ray tube of claim 44, further comprising:

a second power supply including a second positive terminal and the negative terminal, wherein said first electrode is coupled to said second positive terminal.

46. The cathode ray tube of claim 43, further comprising:

a first power supply including a first positive terminal and a negative terminal; and a second power supply including a second positive terminal and the negative terminal, wherein said cathode is coupled to said negative terminal, wherein said first electrode is coupled to said first positive terminal, and wherein said second electrode is coupled to said second positive terminal.

47. A cathode ray tube, comprising:

an electron source including a cathode operable to emit electrons;

an electron beam guidance cavity having an input aperture and an output aperture;

a first electrode operable to apply a first electric field between said output aperture and said cathode;

a second electrode operable to apply a second electric field between said cathode and said second electrode, said second electric field for controlling the emission of electrons from said cathode, said second electrode further operable to transmit at least a portion of the emitted electrons from said cathode to said electron beam guidance cavity, the first electric field and a secondary emission coefficient associated with said electron beam guidance cavity for enabling electron transport through said electron beam guidance cavity in response to the at least a portion of the emitted electrons entering said input aperture; and a filament operable to heat said cathode.

48. The cathode ray tube of claim 47, further comprising:

a first power supply including a first positive terminal and a negative terminal, wherein said filament is coupled to said first positive terminal and said negative terminal, wherein said cathode is coupled to said negative terminal, and wherein said second electrode is coupled to said first positive terminal.

49. The cathode ray tube of claim 48, further comprising:

a second power supply including a second positive terminal and the negative terminal, wherein said first electrode is coupled to said second positive terminal.

50. The cathode ray tube of claim 40, further comprising:

a first power supply including a first positive terminal and a negative terminal; and a second power supply including a second positive terminal and the negative terminal, wherein said cathode is coupled to said negative terminal, wherein said first electrode is coupled to said first positive terminal, and wherein said second electrode is coupled to said second positive terminal.

51. A cathode ray tube, comprising:

an electron source including a cathode operable to emit electrons;

an electron beam guidance cavity having an input aperture and an output aperture;

a first electrode operable to apply a first electric field between said output aperture and said cathode;

a second electrode operable to apply a second electric field between said cathode and said second electrode, said second electric field for controlling the emission of electrons from said cathode, said second electrode further operable to transmit at least a portion of the emitted electrons from said cathode to said electron beam guidance cavity, the first electric field and a secondary emission coefficient associated with said electron beam guidance cavity for enabling electron transport through said electron beam guidance cavity in response to the at least a portion of the emitted electrons entering said input aperture;

a first power supply including a first positive terminal and a negative terminal; and a second power supply including a second positive terminal and the negative terminal, wherein said cathode is coupled to said negative terminal, wherein said first electrode is coupled to said first positive terminal, and wherein said second electrode is coupled to said second positive terminal.

* * * * *